US007128591B2

(12) United States Patent
Tsai

(10) Patent No.: US 7,128,591 B2
(45) Date of Patent: Oct. 31, 2006

(54) ELECTRICAL CONNECTION SOCKET STRUCTURE WITH A MOVABLE INSULATION BLOCK

(76) Inventor: Chou Hsuan Tsai, 15F, No.4, Lane 127, Sec. 1, Fu-Hsing Rd., Hsin-Chuang, Taipei Hsien (TW)

( * ) Notice: Subject to any disclaimer, the term of this patent is extended or adjusted under 35 U.S.C. 154(b) by 0 days.

(21) Appl. No.: 11/265,069

(22) Filed: Nov. 1, 2005

(65) Prior Publication Data

US 2006/0105600 A1 May 18, 2006

(30) Foreign Application Priority Data

Nov. 15, 2004 (TW) ..... 93134948 A

(51) Int. Cl.
*H01R 29/00* (2006.01)

(52) U.S. Cl. ..... 439/188; 439/668

(58) Field of Classification Search ..... 439/188, 439/668

See application file for complete search history.

(56) References Cited

U.S. PATENT DOCUMENTS 6,062,885 A * 5/2000 White ..... 439/188
6,540,535 B1 * 4/2003 Zhu et al. ..... 439/188
6,651,693 B1 * 11/2003 Simmons et al. ..... 137/329.05
6,827,596 B1 * 12/2004 Hori ..... 439/188
6,835,080 B1 * 12/2004 Chang ..... 439/188

* cited by examiner

*Primary Examiner*—Truc Nguyen
(74) *Attorney, Agent, or Firm*—Pro-Techtor Int'l Services

(57) ABSTRACT

An electrical connection socket structure, into which a plug is inserted, includes a plastic base having a hole, terminals disposed in the plastic base, and an insulation block. Each terminal has a pin located below the plastic base and an elastic arm formed with a contact. The terminals comprise a first terminal and a second terminal both having the contacts that may contact or be separated from each other. The insulation block disposed in the plastic base has a contact slant and can move the elastic arm of the first terminal. When the plug is inserted into the hole, the plug pushes the contact slant and moves the insulation block to press the elastic arm of the first terminal such that the contact of the first terminal is electrically connected to or disconnected from the contact of the second terminal after the contacts rubs against each other by a distance.

20 Claims, 10 Drawing Sheets

ELECTRICAL CONNECTION SOCKET STRUCTURE WITH A MOVABLE INSULATION BLOCK

BACKGROUND OF THE INVENTION

1. Field of the Invention

The invention relates in general to an electrical connector, and more particularly to an electrical connection socket structure to be connected to an inserted plug of a signal wire.

2. Description of the Related Art

A conventional electrical connector has to be connected to various different audio signal wires, such as those of a multi-channel speaker, an earphone, a microphone, and the like. So, the connector usually has multiple plugs to be connected to the above-mentioned apparatuses. However, each plug has to correspond to a signal wire of a specific apparatus and the connection fails if the plug is connected to the wrong signal wire.

In order to facilitate the usage of connection so that the user does not have to insert the plug into the correct hole, the manufacturer adds a switch device to the electrical connection socket structure. The switch device is triggered by the inserted plug of the signal wire, and a chipset on a motherboard is enabled to make a selection and a conversion so as to match with the type of the inserted plug. Thus, the user can build a connection without having to insert the plug into the correct hole.

Referring to FIG. 1, a conventional electrical connector includes a plastic base 10 and a plurality of switch devices. The plastic base 10 is formed with a plurality of holes 11 and a circumferential wall of the hole 11 is formed with a flange 12.

Each switch device corresponds to each hole and includes a first terminal 13 and a second terminal 20. The first terminal 13 includes an elastic arm 14 and an extension 15. The elastic arm 14 has one end fixed to the plastic base 10 and the other end formed with a plastic projection 18 by way of injection molding. The extension 15 with an inverse-L shape has a transversal portion 16 and a longitudinal portion 17. A distal end of the transversal portion 16 is also fixed to the plastic base 10 and in contact with the elastic arm 14. A distal end of the longitudinal portion 17 is formed with a pin protruding over the plastic base. The second terminal 20 has a longitudinal portion 21 and a contact sheet 22. The longitudinal portion 21, which is parallel to the longitudinal portion 17 of the first terminal 13, has a lower end formed with a pin protruding over the plastic base. The contact sheet 22 connected in perpendicular to an upper end of the longitudinal portion 21 corresponds to the elastic arm 14 of the first terminal 13 and is formed with a protruding contact point 23.

According to the above-mentioned structure, when a plug 25 for the signal wire is inserted for connection, the plug 25 pushes the plastic projection 18 to bend down the elastic arm 14 of the first terminal 13 and thus electrically connect the first terminal 13 to the second terminal 20, as shown in FIG. 2. Thus, the plug 25 for the signal wire is separated from the first terminal 13 through the plastic projection 18 even if the switch device is ON, such that the plug 25 still can be normally electrically connected to signal terminals (not shown).

The prior art structure has the following drawbacks.

1. A gap between the elastic arm 14 of the first terminal and the contact point 23 of the second terminal 20 is relatively large, as shown in FIG. 2. Thus, when the plug 25 is inserted for connection, the elastic arm 14 of the first terminal 13 is bent down to elastically contact the contact point 23 of the second terminal 20. The contact sheet 22 of the second terminal is not pressed down by a distance, so the frictional effect generated between the elastic arm 14 of the first terminal and the contact point 23 of the second terminal 20 is relatively small, and the oxidation layers on the elastic arm and the contact point cannot be removed.

2. The structure is manufactured by injection molding the plastic projection 18 on the first terminal, so the manufacturing processes are complicated and are not easy, and the throughput is low. Thus, the cost is increased because the metal terminal has to be put in the mold followed by the injection molding.

3. Because it is very difficult to directly mold the plastic projection 18 on the whole first terminal 13 by way of injection molding, the first terminal 13 has to be cut into the elastic arm 14 and the extension 15. Then, the plastic projection 18 is formed on the shorter elastic arm 14. Although the difficulty of injection molding can be reduced, the two members of the first terminal have to be assembled together. So, the manufacturing cost is increased.

SUMMARY OF THE INVENTION

It is therefore an object of the invention to provide an electrical connection socket structure having a first terminal and a second terminal, which can be electrically connected to or disconnected from each other. When a plug of a signal wire is inserted into a hole for connection, two contacts of the two terminals can rub against each other by a distance to form electrical connection or disconnection, such that the effect of scraping and removing oxidation layers on the contacts may be achieved.

Another object of the invention is to provide an electrical connection socket structure, which may be manufactured easily with a reduced manufacturing cost.

The invention achieves the above-identified objects by providing an electrical connection socket structure, into which a plug is inserted for electrical connection. The structure includes a plastic base having a hole, a plurality of terminals disposed in the plastic base, and an insulation block. Each terminal has a pin located below the plastic base and an elastic arm formed with a contact. The terminals comprise a first terminal and a second terminal both having the contacts that may contact each other or be separated from each other. The insulation block disposed in the plastic base has a contact slant and can move the elastic arm of the first terminal. When the plug is inserted into the hole, the plug pushes the contact slant and thus moves the insulation block to press the elastic arm of the first terminal such that the contact of the first terminal is electrically connected to or disconnected from the contact of the second terminal after the contact of the first terminal rubs against the contact of the second terminal by a distance.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 2:
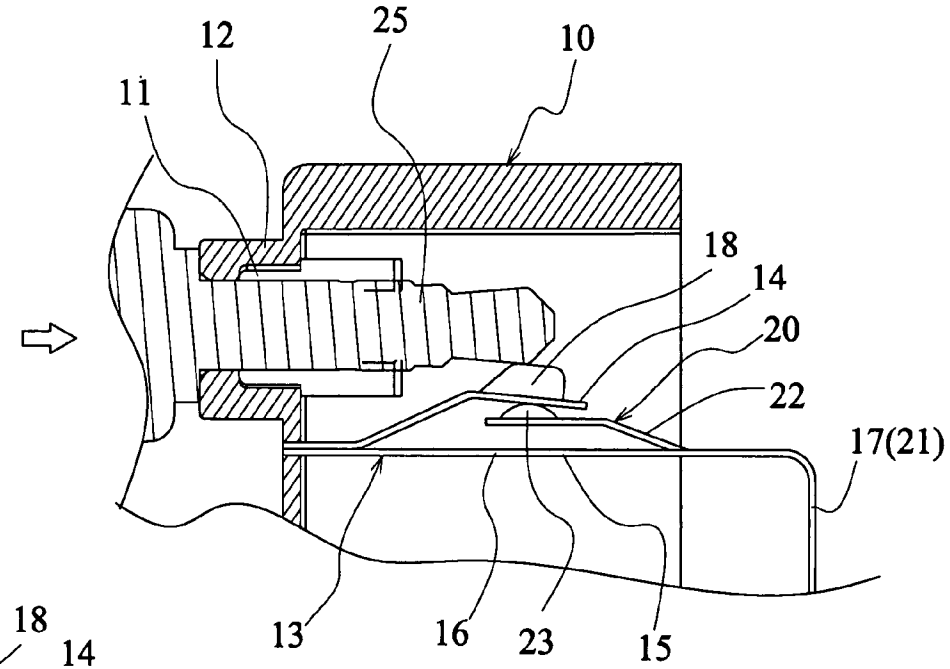
FIG. 2 (Prior Art)
FIG. 2 is a schematic illustration showing a usage state of the conventional electrical connector.
Figure 1:
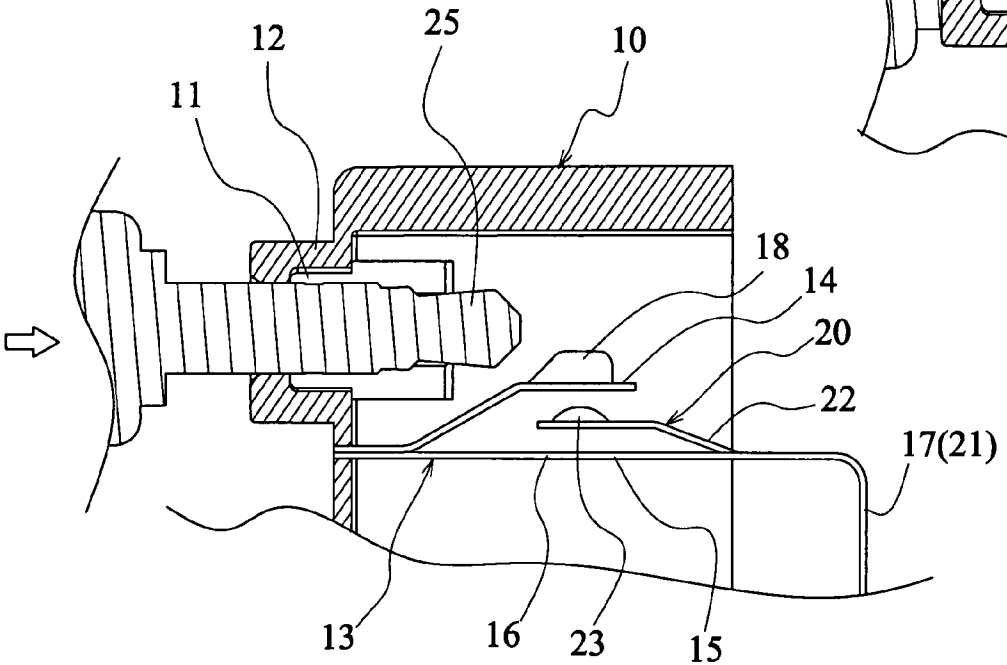
FIG. 1 (Prior Art)
FIG. 1 is a schematically cross-sectional view showing a conventional electrical connector.
Figure 4:
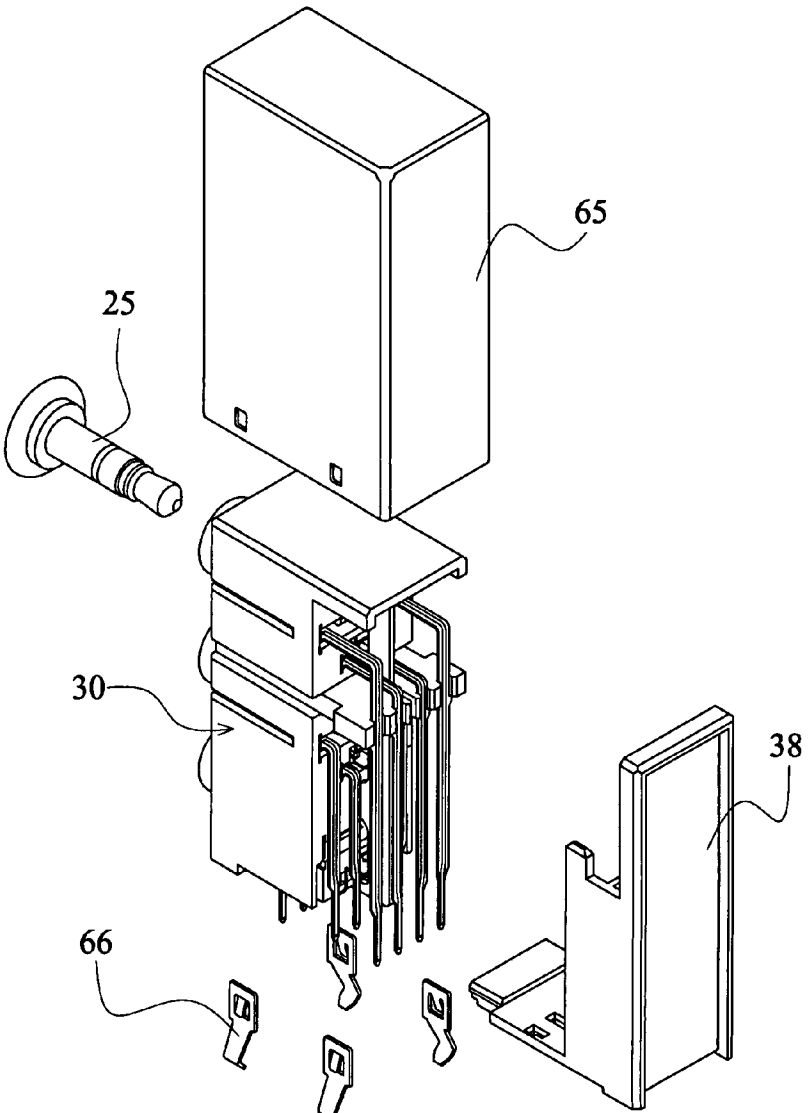
FIG. 4 is a pictorially exploded view showing the first embodiment of the invention.
Figure 3:
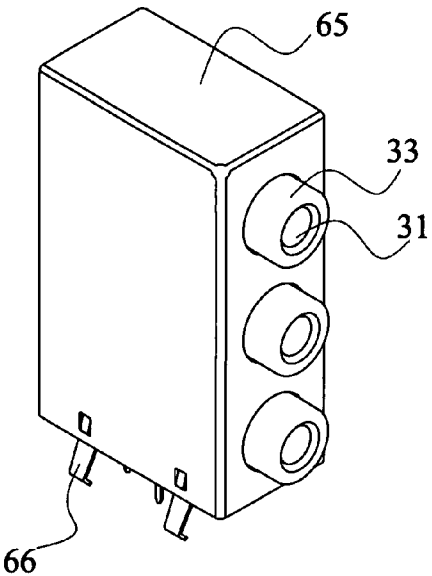
FIG. 3 is a pictorial view showing an electrical connection socket structure according to a first embodiment of the invention.
Figure 5:
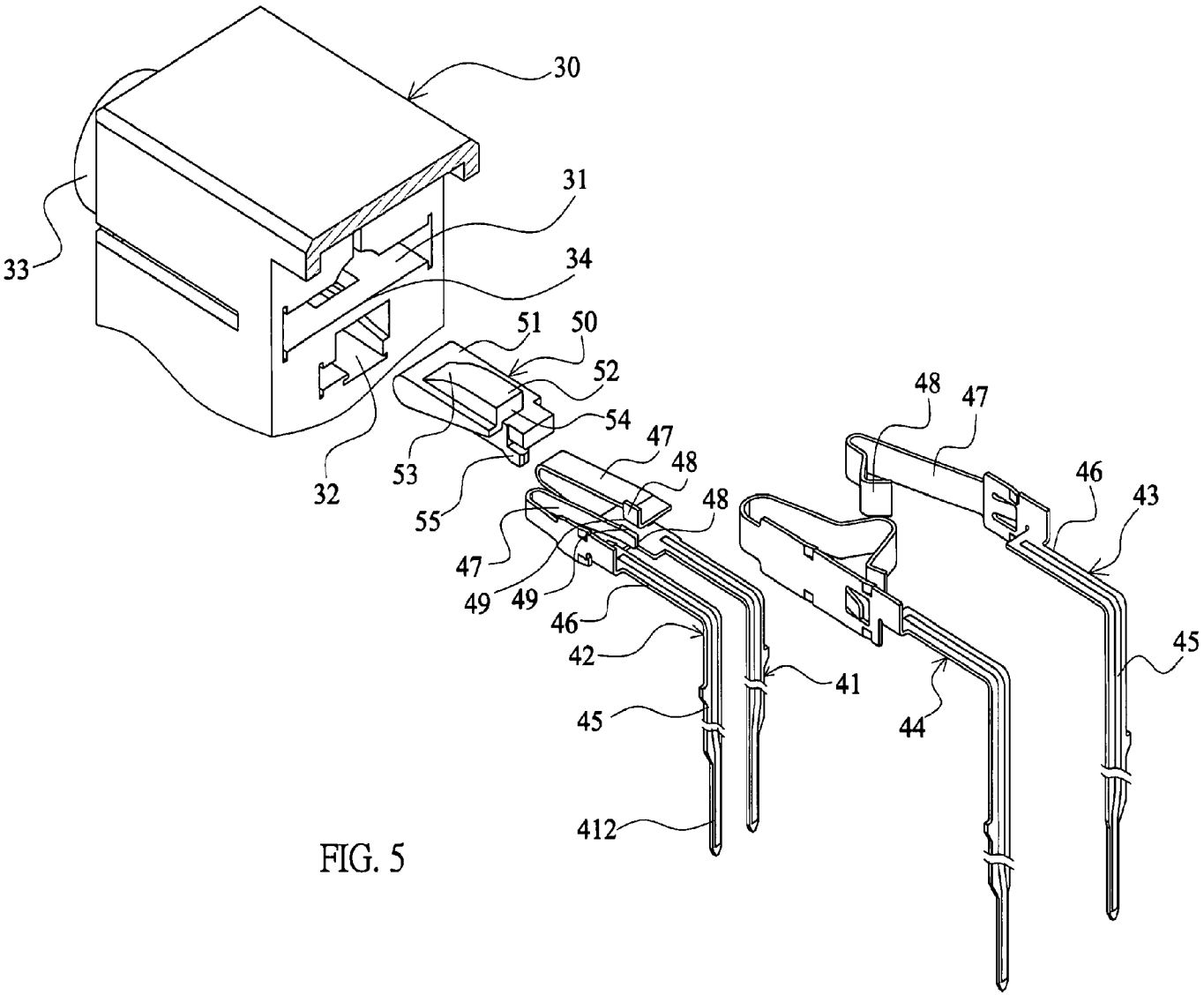
FIG. 5 is a pictorially exploded view showing the first embodiment of the invention.
Figure 7:
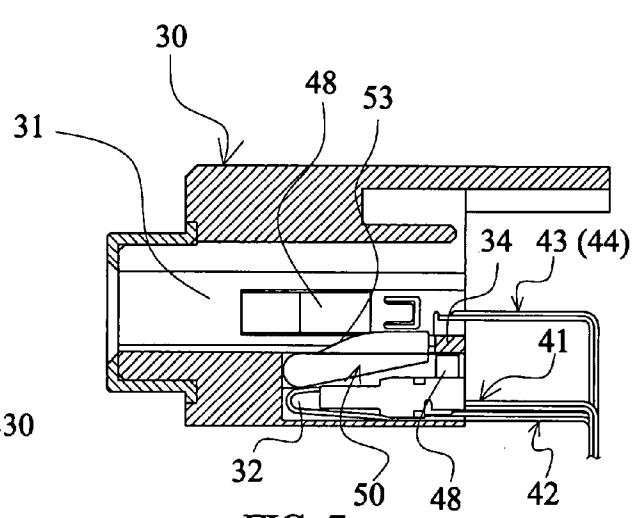
FIG. 7 is an assembled cross-sectional view showing the first embodiment of the invention.
Figure 6:
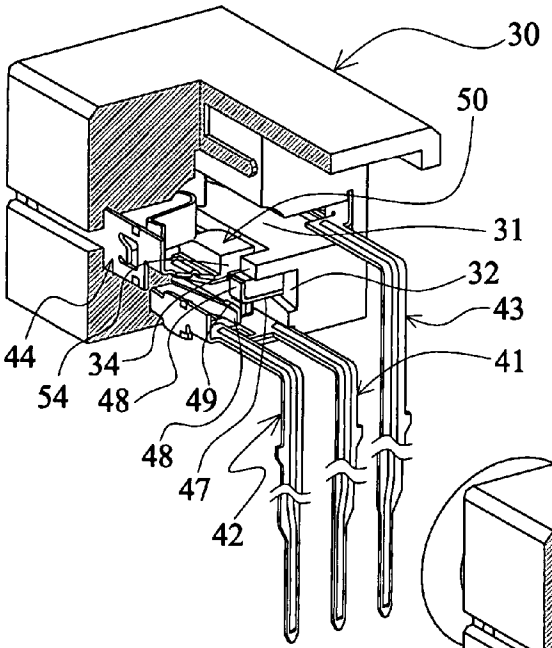
FIG. 6 is a pictorially assembled view showing the first embodiment of the invention.

Referring to FIGS. 3 and 4, this embodiment has three holes and includes a plastic base 30, a plastic rear seat 38 and a metal housing 65. The plastic base 30 includes three electrical connection socket structures arranged in a vertical direction. The plastic rear seat 38 having an L-shape covers a rear end and a lower end of the plastic base 30. The metal housing 65 covers the plastic base 30 and the plastic rear seat 38. Four hooks 66 for fixing the metal housing 65 to a circuit board are disposed at the lower end of the metal housing 65. As shown in FIGS. 5 to 7, each electrical connection socket structure includes a plastic base 30, four terminals and an insulation block 50.

The plastic base 30 is formed with a hole 31 and a chamber 32. The hole 31 has a circumferential wall protruding frontward to form a flange 33. A stopper wall 34 is formed in back of the hole 31. The chamber 32 is located below the hole 31 and communicates with the hole 31.

The four terminals are disposed in the plastic base 30 and include a first terminal 41 and a second terminal 42, which form a switch device, and a third terminal 43 and a fourth terminal 44, which are electrically connected to a plug of a signal wire. Each terminal has a longitudinal portion 45 and a transversal portion 46 perpendicular to the longitudinal portion 45. A lower end of the longitudinal portion 45 is formed with a longitudinal pin 412 extending out of the lower end of the plastic base. The transversal portion 46 extends into the plastic base 30 and is formed with an elastic arm 47, which has a contact 48. Plate faces of the elastic arms 47 of the third terminal 43 and the fourth terminal 44 are longitudinal and located at two sides of the hole 31. The elastic arms 47 of the first terminal 41 and the second terminal 42 are located in the chamber 32. A plate face of the first terminal 41 is horizontal and bent back to form a U shape. A plate face of the second terminal 42 is longitudinal and bent back to form a U shape. Plate faces of the contacts 48 of the first terminal 41 and the second terminal 42 are longitudinal and a vertical gap is formed between the plate faces of the contacts 48 of the first terminal 41 and the second terminal 42. The contact 48 of the first terminal 41 is higher than the contact 48 of the second terminal 42. An upper end of the contact 48 of the second terminal 42 is formed with a guide-in slant (or surface) 49 to guide the contact 48 of the first terminal 41 to slide in for contact. Also, the contact 48 of the first terminal 41 is formed with a guide-in surface 49 to guide the contact 48 of the first terminal 41 to slide in for contact.

The insulation block 50 has a platen 51. A projection 52 is formed on the middle of the platen 51. A front end of the projection 52 is formed with a contact slant 53. A rear end of the projection 52 is formed with a stopping portion 54. The lower end of the platen is formed with a longitudinal resting portion 55. The insulation block 50 is disposed in the chamber 32 of the plastic base. The platen 51 rests against the elastic arm 47 of the first terminal 41. The resting portion 55 rests against the contact 48 of the second terminal 42. The projection 52 extends into the hole 31, and the stopping portion 54 rests against the stopper wall 34.

As shown in FIGS. 6 and 7, when a plug 25 of a signal wire is not inserted into the hole 31, the insulation block 50 is pushed by the resilience of the elastic arm 47 of the first terminal 41 and located at the upper bound position. So, the contact slant 53 protrudes over the hole 31, and the resting portion 55 rests against the contact 48 of the second terminal 42 to prevent the contact 48 of the second terminal 42 from contacting the air and oxidizing. The stopping portion 54 rests against the stopper wall 34.

Figure 9:
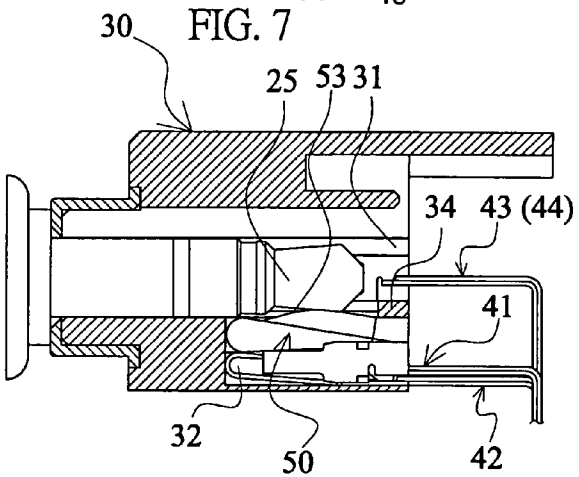
FIG. 9 is a cross-sectional view showing the usage state according to the first embodiment of the invention.
Figure 8:
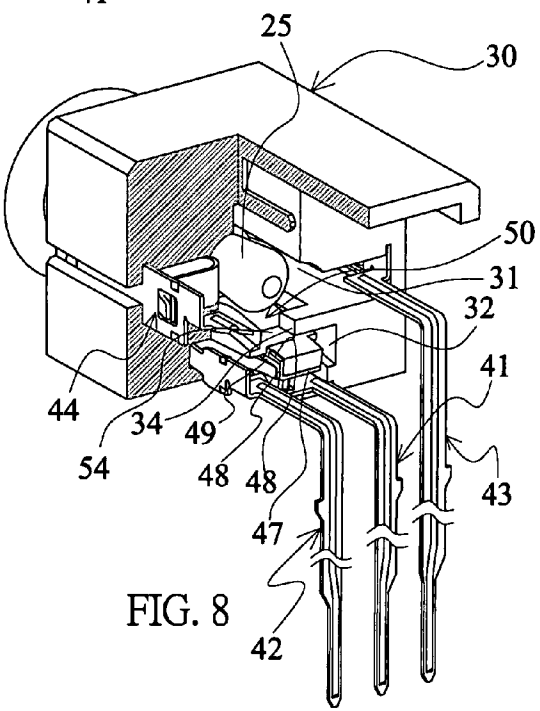
FIG. 8 is a pictorial view showing a usage state according to the first embodiment of the invention.

As shown in FIGS. 8 and 9, when the plug 25 is inserted into the hole 31, the plug 25 is electrically connected to the contacts 48 of the third terminal 43 and the fourth terminal 44 while pushing the contact slant 53 of the insulation block 50, such that the insulation block 50 is gradually moved downward to press the elastic arm 47 of the first terminal 41, and the contact 48 of the first terminal 41 is moved downward to contact the contact 48 of the second terminal 42 and then slide against the contact 48 of the second terminal 42 by a longitudinal distance.

Because the contacts 48 of the first terminal 41 and the second terminal 42 can rub against each other when the connection is made, the oxidation layers on the contacts may be scraped and removed.

Figure 10:
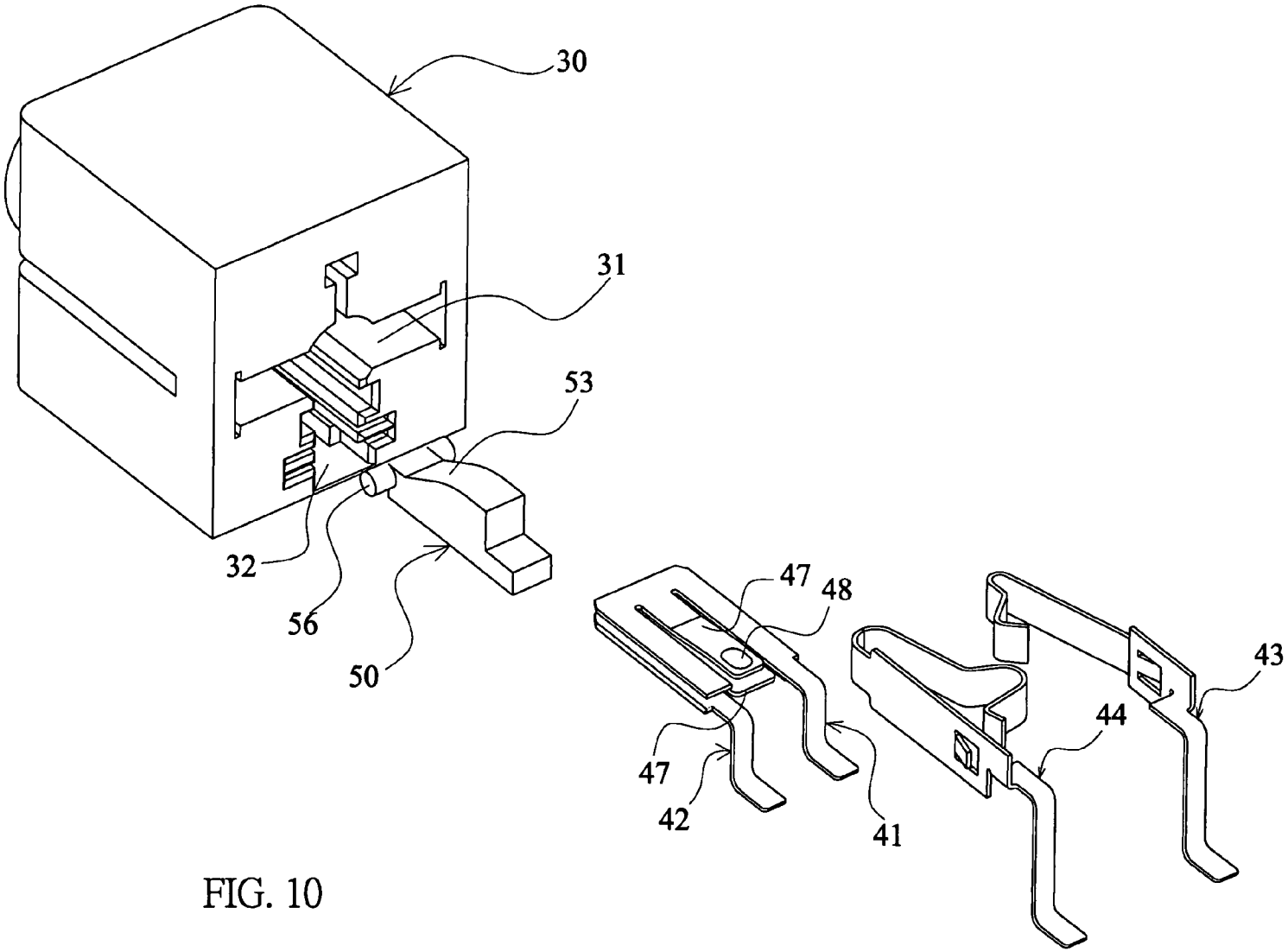
FIG. 10 is a pictorially exploded view showing a second embodiment of the invention.
Figure 11:
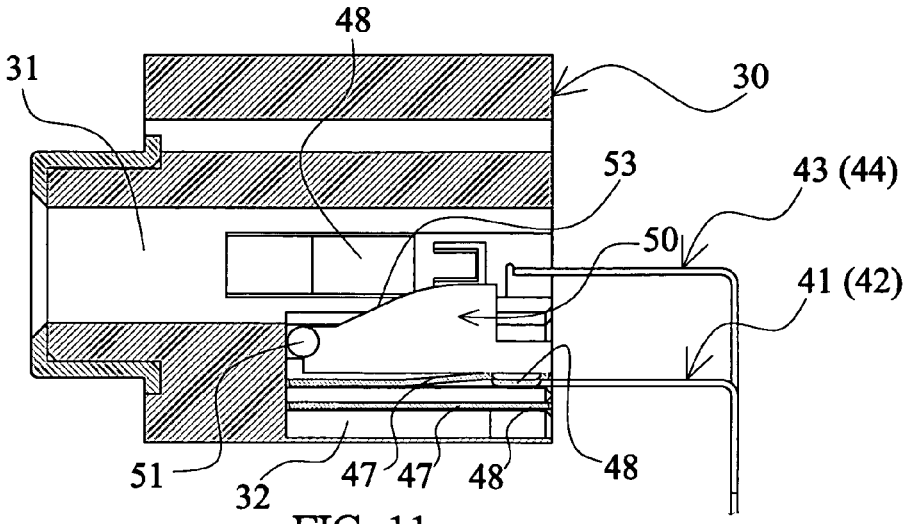
FIG. 11 is an assembled cross-sectional view showing the second embodiment of the invention.

As shown in FIGS. 10 and 11, the second embodiment is almost the same as the first embodiment except that this embodiment has a single hole. The plate faces of the contacts 48 of the first terminal 41 and the second terminal 42 are horizontal and located in the chamber 32 with a gap formed therebetween. In addition, the pin 412 is horizontal. One end of the insulation block 50 is formed with a pivot 56 and the insulation block 50 is formed with only one contact slant 53. The pivot 56 is pivoted on the sidewall of the chamber 32 of the plastic base 30 and then directly rests against the elastic arm 47 of the first terminal 41. Because the insulation block 50 is pivoted on the plastic base 30, no stopper has to be formed at a rear end of the hole of the plastic base 30.

Figure 12:
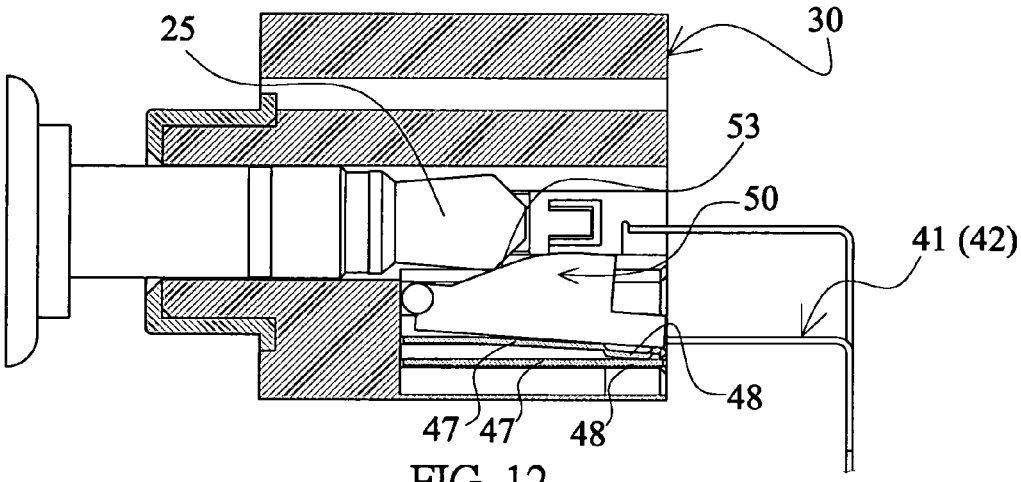
FIG. 12 shows a usage state according to the second embodiment of the invention.
Figure 13:
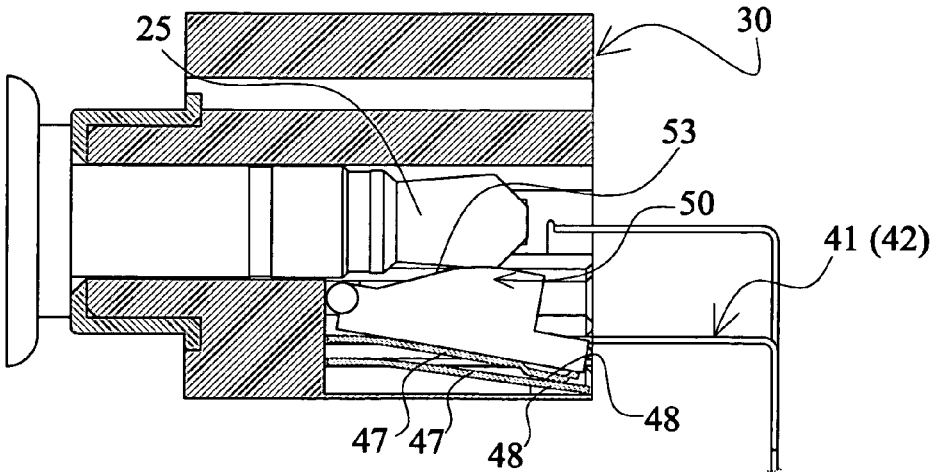
FIG. 13 shows the usage state according to the second embodiment of the invention.

As shown in FIG. 12, when the plug 25 is initially inserted into the hole 31, the plug 25 is electrically connected to the contacts 48 of the third terminal 43 and the fourth terminal 44 while pushing the insulation block 50 to move downward and press the elastic arm 47 of the first terminal 41. At this time, the electrical connection between the contacts 48 of the first terminal 41 and the second terminal 42 has been built. As shown in FIG. 13, when the plug 25 is further inserted to reach a deepest state, the insulation block 50 is continuously moved downward to press the elastic arms 47 of the first terminal 41 and the second terminal 42 to move by a distance, such that the contacts 48 of the first terminal 41 and the second terminal 42 can rub against each other during the moving action, and the effect of scraping and removing the oxidation layers thereof may be achieved.

Figure 14:
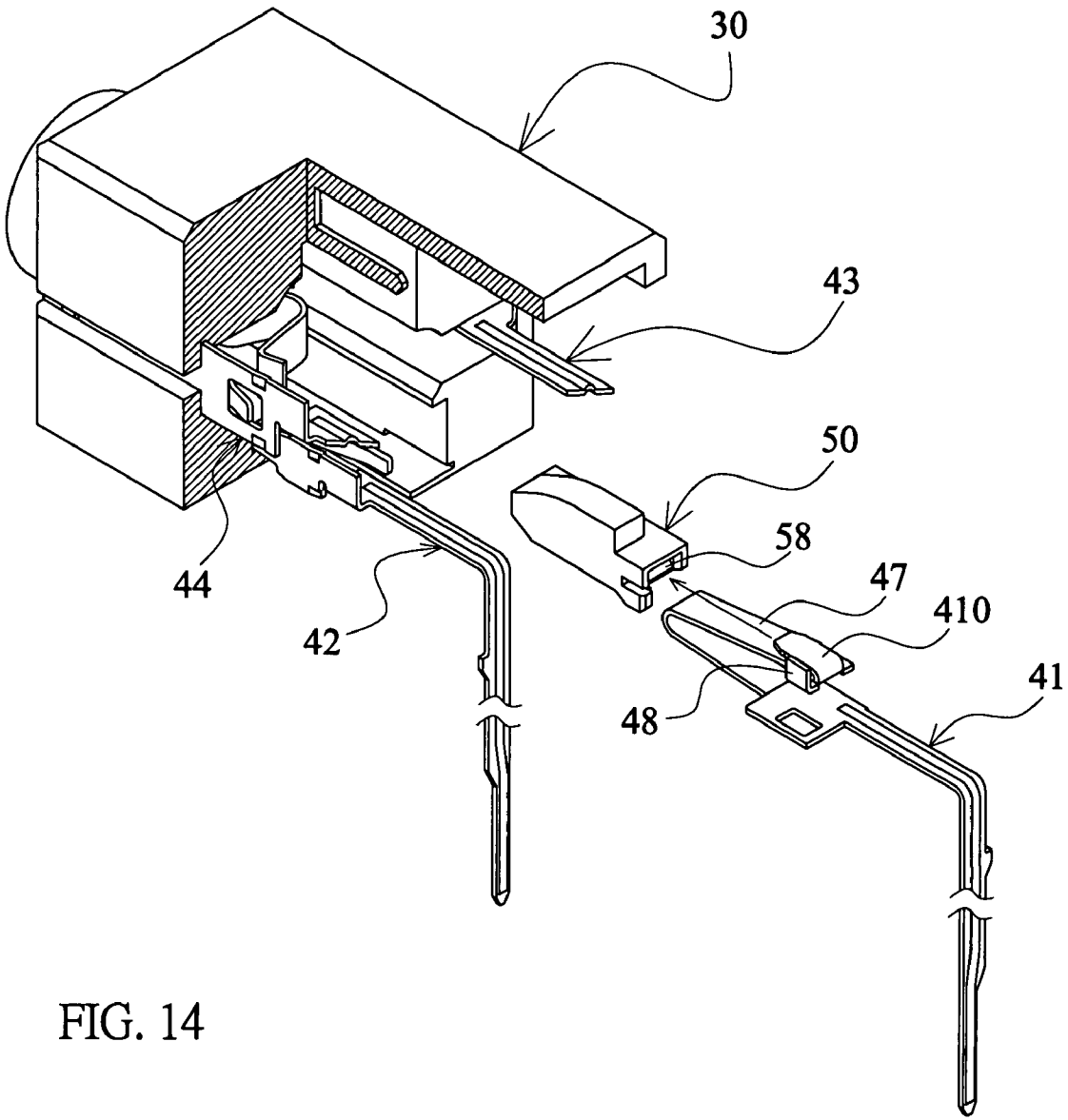
FIG. 14 is a pictorially exploded view showing a third embodiment of the invention.

As shown in FIG. 14, the third embodiment is almost the same as the first embodiment except that a slot 58 is formed at a rear end of the insulation block 50. The distal end of the elastic arm 47 of the first terminal is bent back to form an engaging portion 410. The engaging portion 410 of the elastic arm 47 of the first terminal engages with the slot 58 of the insulation block 50.

Figure 15:
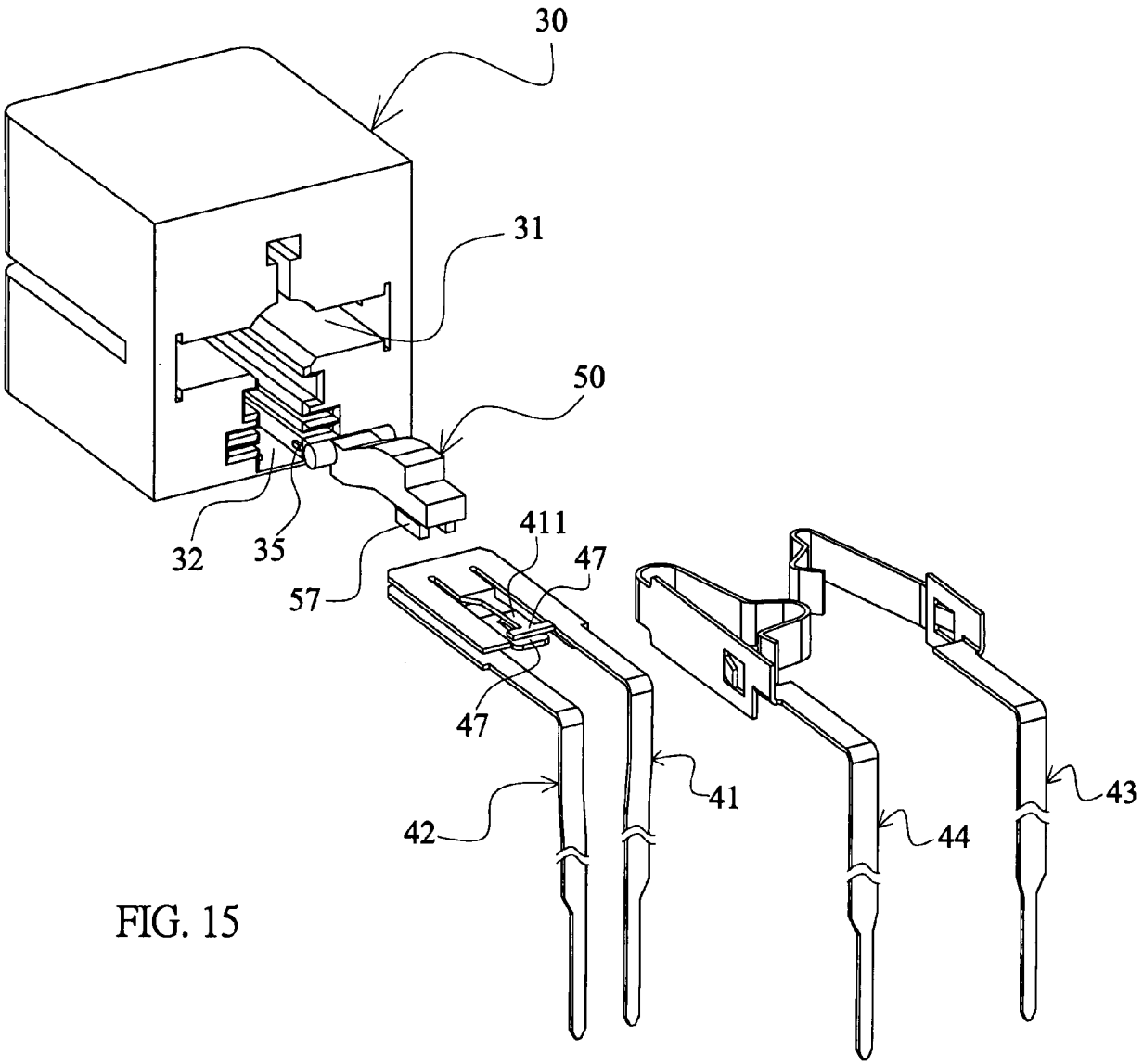
FIG. 15 is a pictorially exploded view showing a fourth embodiment of the invention.
Figure 16:
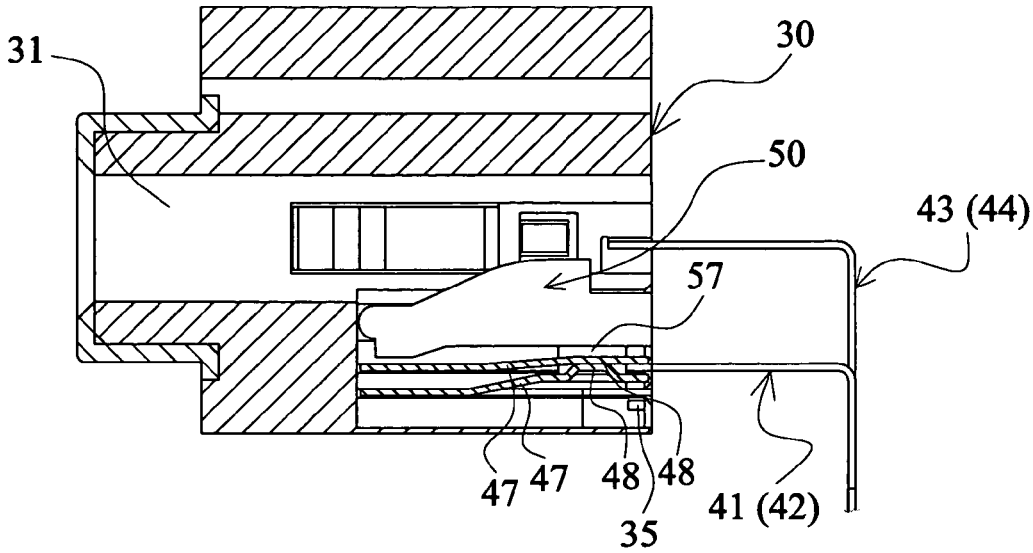
FIG. 16 is an assembled cross-sectional view showing the fourth embodiment of the invention.

As shown in FIGS. 15 and 16, the fourth embodiment is almost the same as the second embodiment except that the contacts 48 of the first terminal 41 and the second terminal 42 elastically contact each other when the plug is not inserted into the hole 31. The elastic arm 47 of the first terminal 41 has a downward resilience to elastically contact the elastic arm 47 of the second terminal 42. The plate face of the middle section of the elastic arm 47 of the first terminal 41 is narrower to form a narrower region 411. The lower end of the insulation block 50 is formed with two tabs 57. When the insulation block 50 rests against the elastic arm 47 of the first terminal 41, the tabs 57 pass through two sides of the narrower region 411 and then rest against the elastic arm 47 of the second terminal 42. In addition, two sides of the chamber 32 of the plastic base 30 are formed with two stopping blocks 35, respectively.

Figure 17:
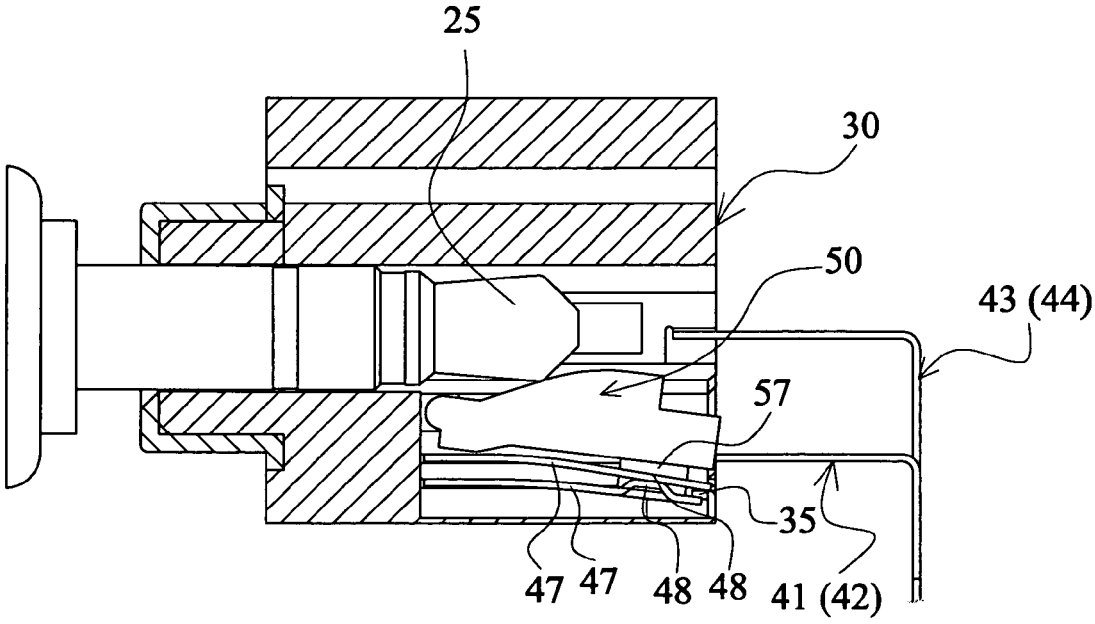
FIG. 17 shows a usage state according to the fourth embodiment of the invention.

As shown in FIG. 17, when the plug 25 is initially inserted into the hole 31 to press the insulation block 50 to move downward, the tabs 57 press the elastic arm 47 of the second terminal 42. At this time, the elastic arm 47 of the first terminal 41 has a downward resilience, so the elastic arm 47 of the first terminal 41 still presses the elastic arm 47 of the second terminal 42. Thus, during the initial inserting action, the contacts 48 of the first terminal 41 and the second terminal 42 are still in contact with each other, and can rub against each other during this moving action such that the effect of scraping and removing the oxidation layers on the contacts 48 may be achieved.

Figure 18:
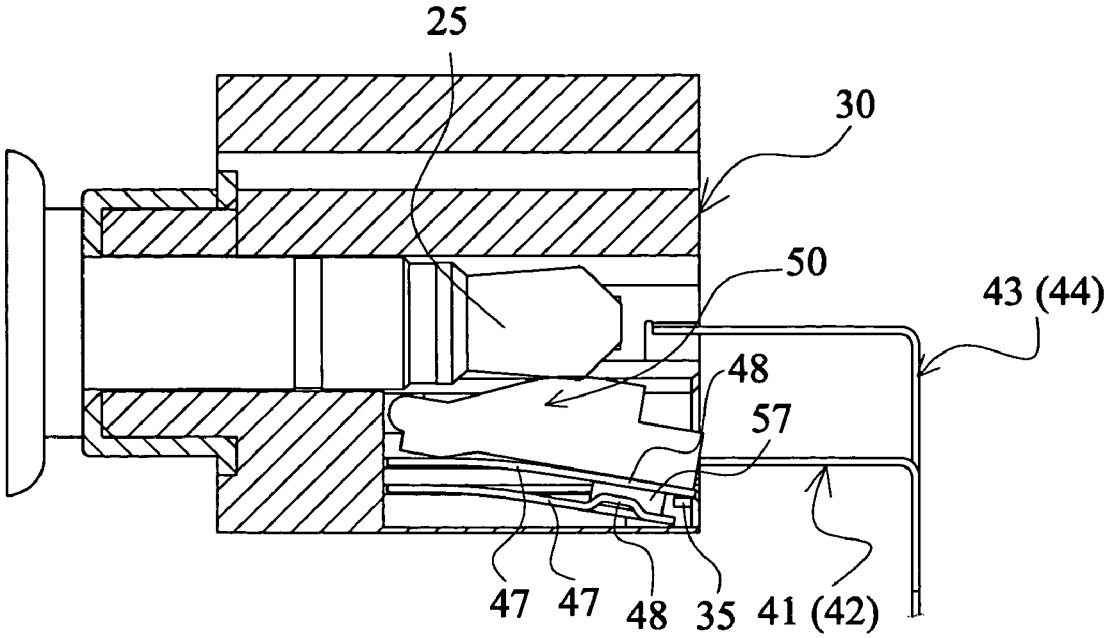
FIG. 18 shows the usage state according to the fourth embodiment of the invention.

As shown in FIG. 18, when the plug 25 is further inserted to a deepest state, the insulation block 50 is continuously moved down to press the elastic arm 47 of the second terminal 42. At this time, the distal end of the elastic arm 47 of the first terminal 41 rests against the stopping block 35 of the chamber 32 and will no longer be pressed down. Thus, the contacts 48 of the first terminal 41 and the second terminal 42 can be separated from each other.

Because this embodiment is designed according to special requirements, the function thereof is just reverse to that of the second embodiment.

Figure 19:
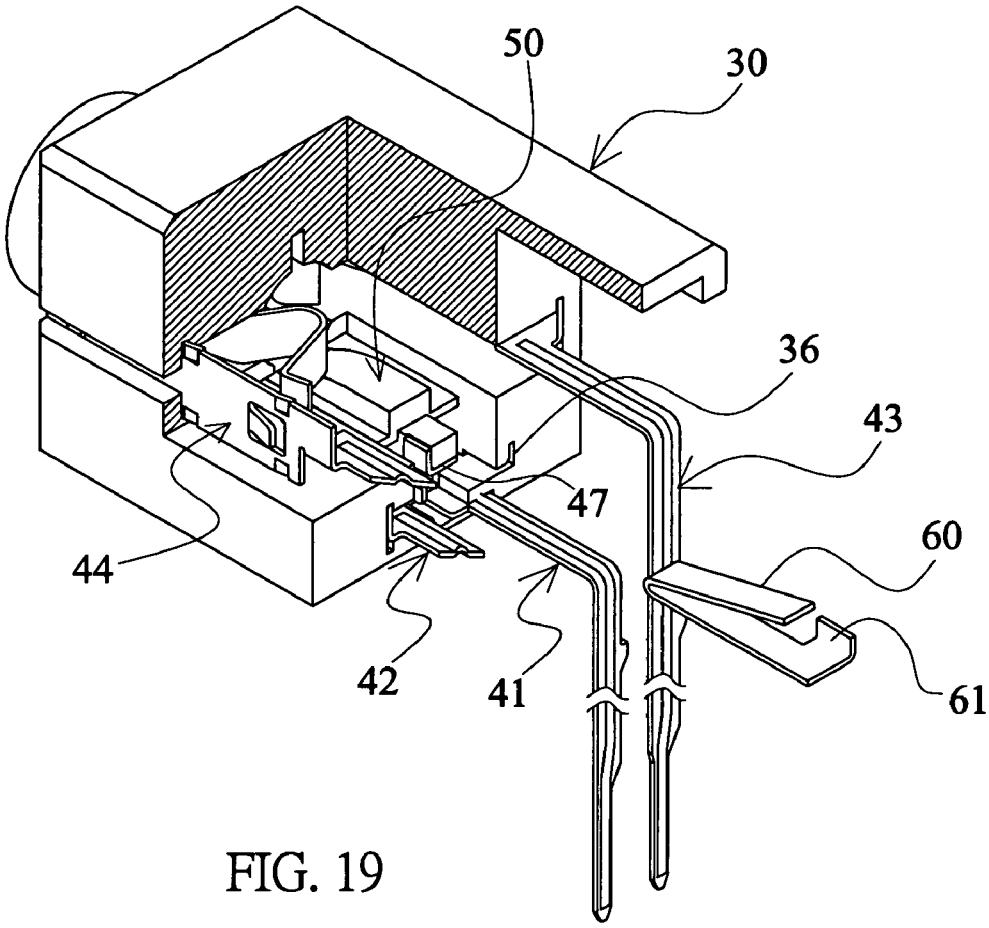
FIG. 19 is a pictorially exploded view showing a fifth embodiment of the invention.

Referring to FIG. 19, the fifth embodiment is almost the same as the first embodiment except that the fifth embodiment further includes an elastic member 60 for providing a restoring force after the insulation block 50 is moved. The plastic base 30 has a slot 36. An engaging sheet 61 is formed at a side of the elastic member 60. The engaging sheet 61 of the elastic member 60 is inserted to the slot 36 of the plastic base 30 for engagement. Thus, the elastic member 60 can be located under the insulation block 50 and thus provide the restoring force after the insulation block 50 is moved. In this embodiment, the additional elastic member 60 can provide a larger restoring force for the insulation block 50, and can compensate for the insufficient resilience of the elastic arm 47 of the first terminal 41.

The invention has the following advantages.

1. The contacts 48 of the first terminal 41 and the second terminal 42 of the switch device can rub against each other by a distance as the insulation block 50 is moved, and the effect of scraping and removing the oxidation layers on the contacts can be achieved.

2. The insulation block 50 can be simply designed and manufactured, so the manufacturing cost can be reduced.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An electrical connection socket structure, into which a plug of a signal wire is inserted for electrical connection, the structure comprising:

a plastic base having a hole;

a plurality of terminals disposed in the plastic base, wherein each of the plurality of terminals has a pin and an elastic arm, the pin is located below the plastic base, the elastic arm is formed with a contact, and the plurality of terminals comprises a first terminal and a second terminal both having the contacts that may contact each other or be separated from each other; and an insulation block, which is disposed in the plastic base, has a contact slant, and can move the elastic arm of the first terminal, wherein when the plug is inserted into the hole of the plastic base, the plug pushes the contact slant of the insulation block and thus moves the insulation block to press the elastic arm of the first terminal such that the contact of the first terminal is electrically connected to or disconnected from the contact of the second terminal after the contact of the first terminal rubs against the contact of the second terminal by a distance;

the contacts of the first terminal and the second terminal are spaced apart by a vertical gap, and the contact of the first terminal is wider than the contact of the second terminal;

at least one of the contacts of the first and second terminals has a longitudinal plate face; and at least one of the contacts of the first and second terminal is formed with a guide-in surface to guide the contact of the first terminal to slide in for contact with the contact of the second terminal.

2. The structure according to claim 1, wherein the plurality of terminals comprises a third terminal and a fourth terminal, which are electrically connected to the plug.

3. The structure according to claim 1, wherein the insulation block rests against the elastic arm, of the first terminal.

4. The structure according to claim 1, further comprising an elastic member, which is located under the insulation block, for providing a resilience to restore the insulation block back to a position at which the insulation block does not press the elastic arm of the first terminal yet.

5. The structure according to claim 1, wherein each of the elastic arms of the first and second terminals is bent back to form a U shape.

6. The structure according to claim 1, wherein:

the insulation block has a platen;

a projection is formed on a middle of the platen;

a front end of the projection is formed with the contact slant;

a rear end of the projection is formed with a stopping portion;

a stopper wall is formed at a rear end of the hole of the plastic base; and the stopping portion of the insulation block rests against the stopper wall.

7. The structure according to claim 1, wherein a lower end of the insulation block is formed with a blocking member resting against the contact of the second terminal.

8. The structure according to claim 1, wherein one end of the insulation block is pivoted on the plastic base.

9. The structure according to claim 1, wherein the insulation block is fixed to the elastic arm of the first terminal.

10. An electrical connection socket structure, into which a plug of a signal wire is inserted for electrical connection, the structure comprising:

a plastic base having a hole;

a plurality of terminals disposed in the plastic base, wherein each of the plurality of terminals has a pin and an elastic arm, the pin is located below the plastic base, the elastic arm is formed with a contact, and the plurality of terminals comprises a first terminal and a second terminal both having the contacts that may contact each other or be separated from each other; and an insulation block, which is disposed in the plastic base, has a contact slant, and can move the elastic arm of the first terminal, wherein when the plug is inserted into the hole of the plastic base, the plug pushes the contact slant of the insulation block and thus moves the insulation block to press the elastic arm of the first terminal such that the contact of the first terminal is electrically connected to or disconnected from the contact of the second terminal after the contact of the first terminal rubs against the contact of the second terminal by a distance;

the insulation block has a platen;

a projection is formed on a middle of the platen;

a front end of the projection is formed with the contact slant;

a rear end of the projection is formed with a stopping portion;

a stopper wall is formed at a rear end of the hole of the plastic base; and the stopping portion of the insulation block rests against the stopper wall.

11. The structure according to claim 10, wherein the plurality of terminals comprises a third terminal and a fourth terminal, which are electrically connected to the plug.

12. The structure according to claim 10, wherein the insulation block rests against the elastic arm of the first terminal.

13. The structure according to claim 10, further comprising an elastic member, which is located under the insulation block, for providing a resilience to restore the insulation block back to a position at which the insulation block does not press the elastic arm of the first terminal yet.

14. The structure according to claim 10, wherein the contacts of the first terminal and the second terminal are spaced apart by a vertical gap, and the contact of the first terminal is wider than the contact of the second terminal.

15. The structure according to claim 14, wherein at least one of the contacts of the first and second terminals has a longitudinal plate face, and at least one of the contacts of the first and second terminal is formed with a guide-in surface to guide the contact of the first terminal to slide in for contact with the contact of the second terminal.

16. The structure according to claim 10, wherein each of the elastic arms of the first and second terminals is bent back to form a U shape.

17. The structure according to claim 15, wherein a lower end of the insulation block is formed with a blocking member resting against the contact of the second terminal.

18. An electrical connection socket structure, into which a plug of a signal wire is inserted for electrical connection, the structure comprising:

a plastic base having a hole;

a plurality of terminals disposed in the plastic base, wherein each of the plurality of terminals has a pin and an elastic arm, the pin is located below the plastic base, the elastic arm is formed with a contact, and the plurality of terminals comprises a first terminal and a second terminal both having the contacts that may contact each other or be separated from each other; and an insulation block, which is disposed in the plastic base, has a contact slant, and can move the elastic arm of the first terminal, wherein when the plug is inserted into the hole of the plastic base, the plug pushes the contact slant of the insulation block and thus moves the insulation block to press the elastic arm of the first terminal such that the contact of the first terminal is electrically connected to or disconnected from the contact of the second terminal after the contact of the first terminal rubs against the contact of the second terminal by a distance; and the structure further comprises an elastic member, which is located under the insulation block, for providing a resilience to restore the insulation block back to a position at which the insulation block does not press the elastic arm of the first terminal yet.

19. The structure according to claim 18, wherein the contacts of the first terminal and the second terminal are spaced apart by a vertical gap, and the contact of the first terminal is wider than the contact of the second terminal.

20. The structure according to claim 18, wherein:

the insulation block has a platen;

a projection is formed on a middle of the platen;

a front end of the projection is formed with the contact slant;

a rear end of the projection is formed with a stopping portion;

a stopper wall is formed at a rear end of the hole of the plastic base; and the stopping portion of the insulation block rests against the stopper wall.

* * * * *